US006692118B2

(12) United States Patent
Michele et al.

(10) Patent No.: US 6,692,118 B2
(45) Date of Patent: Feb. 17, 2004

(54) PIERCEABLE SEALING ELEMENT AND INK RESERVOIR WITH PIERCEABLE SEALING ELEMENT

(75) Inventors: Helmut Michele, Castrop-Rauxel (DE); Dirk Klein, Breckerfeld (DE); Peter Busch, Bochum (DE)

(73) Assignee: Artech GmbH Design + Production in Plastic (DE)

( * ) Notice: Subject to any disclaimer, the term of this patent is extended or adjusted under 35 U.S.C. 154(b) by 0 days.

(21) Appl. No.: 10/032,158

(22) Filed: Dec. 31, 2001

(65) Prior Publication Data

US 2002/0084596 A1 Jul. 4, 2002

(51) Int. Cl.[7] ..... B41J 2/175
(52) U.S. Cl. ..... 347/86
(58) Field of Search ..... 347/85, 86, 87; 604/87

(56) References Cited

U.S. PATENT DOCUMENTS 4,516,967 A * 5/1985 Kopfer ..... 604/87
5,949,458 A * 9/1999 Studholme ..... 347/86
6,238,042 B1 * 5/2001 Kobayashi et al. ..... 347/86

FOREIGN PATENT DOCUMENTS

| | | |
|---|---|---|
| DE | 195 34 578 | 3/1996 |
| DE | 696 05 713 | 12/1996 |
| DE | 198 49 567 | 5/2000 |
| DE | 199 62 662 | 7/2001 |

* cited by examiner

*Primary Examiner*—Anh T. N. Vo
(74) *Attorney, Agent, or Firm*—Hoffman Wasson & Gitler PC

(57) ABSTRACT

This invention relates to a pierceable sealing element for a liquid outlet, especially an ink outlet opening of an ink reservoir in inkjet printing means, and an ink reservoir with one such sealing element which has a membrane which can be pierced by a hollow needle for removing liquid, and the hollow needle can be surrounded sealed from the outside by the pierced seal element. To form an improved seal with low production and installation cost it is proposed as claimed in the invention that the membrane is surrounded by an annularly peripheral sealing profile which can be twisted in the manner of a torus at least partially around a peripheral line when the membrane has been pierced, a sealing surface which runs radially on the inside being formed.

39 Claims, 4 Drawing Sheets

PIERCEABLE SEALING ELEMENT AND INK RESERVOIR WITH PIERCEABLE SEALING ELEMENT

BACKGROUND OF THE INVENTION

This invention relates to a pierceable sealing element for a liquid outlet, especially the ink outlet opening of an ink reservoir in inkjet printing means, which has a piercing area which can be pierced by a hollow needle for removing liquid, and the hollow needle can be surrounded sealed from the outside by the pierced seal element. An ink reservoir for detachable mounting in inkjet printing means with an ink outlet opening which is sealed by one such pierceable sealing element is likewise the subject matter of the invention.

To remove liquid as necessary, for example from an ink reservoir, sealing liquid-tight the outlet or removal opening with a closed sealing element which is intact before use is known. The liquid can be removed by means of a hollow needle which is plunged from the outside into the filled reservoir interior through the piercing area of the sealing element intended for this purpose. These sealing elements are used preferably in inkjet printing systems where the interchangeable ink reservoirs, the so-called ink cartridges, are first sealed on their ink outlet opening with one such pierceable sealing element after filling with ink during manufacture. The inkjet printer has a corresponding hollow needle which pierces the sealing element when the ink cartridge is being used and the ink contained in the ink cartridge can be supplied to the print head.

The important advantage of a pierceable sealing element is that it is sealed tight before the first use, i.e. the first perforation by the hollow needle, so that the liquid contained in the reservoir can neither emerge uncontrolled from the liquid outlet nor evaporate. Especially in ink cartridges is this particularly important since after production and filling with ink in general they are only used after some time. Even when stored for a longer time it must be ensured that neither the ink fill level is reduced nor the consistency of the ink adversely changed by vaporization.

One possibility for implementing a pierceable sealing element consists in the attachment of a liquid-tight and vapor-tight sealing film from the outside on the outlet opening. So that it can be easily pierced, i.e. clears the outlet when the generally relatively blunt hollow needle is plunged through, this sealing film consists of thin, relatively poorly elastic plastic material. In this way, when the piercing area is punctured it is completely ruptured and clears the outlet cross section. One such sealing film however does not perform a sealing function so that in the sealing element there must be additional sealing rings which seal against the outside periphery of the hollow needle so that liquid cannot emerge there uncontrolled along the hollow needle. These arrangements, as are described for example in EP 1 000 753 A1, are relatively complex due to the separate sealing elements.

A less complex version of a pierceable seal is a so-called septum. It has a relatively thick piercing area of rubber or thermoplastic elastomer. This piercing area bursts when the hollow needle is inserted, not over its entire surface in an uncontrolled manner, like a sealing film, but is essentially penetrated only in the cross sectional area of the hollow needle. Due to the elasticity of the rubber or elastomer material, the boundary surface of the puncture channel formed in doing so is pressed against the outside periphery of the hollow needle so that a certain sealing is achieved without additional sealing elements. Moreover when the hollow needle is removed the puncture channel is automatically reclosed. But when examined minutely, it is found that when the hollow needle punctures, the material of the septum is not radially displaced in a uniform manner, but a small lengthwise tear forms. In the area of the ends of the tear however along the puncture channel between the material of the septum and the outside periphery of the hollow needle gusset-like passages are formed. For this reason leaks are inevitable, especially when there is liquid in the container for a longer time, on the septum, as is the case in an inkjet printing systems. Likewise attempts have already been made to mold a piercing area with a reduced material thickness into the septum. But the results are however likewise not completely satisfactory since the seal can likewise be adversely affected by the irregular tear edges in the penetration channel.

In view of the aforementioned problems in the prior art, the motivation for the invention is to make available a pierceable sealing arrangement and an ink reservoir with one such sealing arrangement which has improved functionality with respect to the indicated problems. In particular, sealing to the hollow needle which is improved compared to a septum will be achieved and the production and installation cost will be as low as possible, especially less than in a multi-part arrangement with seals and a separate sealing film.

To solve the aforementioned problem as claimed in the invention an ink reservoir with a pierceable sealing element and a pierceable sealing element of the initially mentioned type are proposed in which the piercing area is surrounded by an annularly peripheral sealing profile which can be twisted in the manner of a torus at least partially around a peripheral line when the piercing area has been pierced, a sealing surface which runs radially on the inside being formed.

SUMMARY OF THE INVENTION

As claimed in the invention a novel sealing element is made available which has clearly distinguishable operating areas in one component. One particular feature compared to the prior art consists in that the two functions, specifically on the one hand the sealing function by a piercing area which can be ripped open only if necessary and on the other hand the sealing function with respect to the hollow needle in the penetrated state, are implemented by a functionally connected arrangement of the central piercing area with a special sealing profile which is formed or activated only when pierced.

In the initial state, before the sealing element has been pierced by a hollow needle, the piercing area extends for example in the form of a thin membrane over the opening cross section of an annular sealing profile which is inserted for its part tightly into the outlet opening, for example the ink outlet opening of an ink cartridge for an inkjet printing means. If from the outside a hollow needle is plunged into the piercing area, it tears or bursts so that the liquid outlet is cleared for example for ink removal through the hollow needle.

As was detailed initially, it can be assumed that the piercing channel or the tear edges of the piercing area at best provide for unsatisfactory sealing of the hollow needle in the outlet opening. The special advantage of the invention at this point consists in that when the piercing area is ripped open and with the associated radial bending-up of the separate parts of the piercing area which are connected in their outer edge areas to the sealing profile which runs peripherally there, the sealing profile is cleared and activated for sealing of the hollow needle. To do this, the sealing profile as claimed in the invention is actively manipulated by its being ripped open, i.e. the piercing of the piercing area, such that it is twisted toroidally on its inner periphery in the puncture direction of the hollow needle, i.e. that the surface areas of the sealing profile which are outside with respect to the puncture direction are swivelling radially to the inside in the direction of the pierced opening in an arc-shaped swivelling motion. In this way the actuation or formation of the sealing profile takes place such that annular surface areas of the sealing profile which are initially farther to the outside are swivelled to the inside, by which a defined sealing surface which runs radially to the inside is formed. This surface can uniformly adjoin the surface of the inserted hollow needle over the periphery. Because this sealing surface is a defined surface area which is uniformly smooth especially over its periphery, the sealing of the hollow needle is especially good. Due to the toroidal connection, moreover the edge areas of the piercing area which are separated from one another are swivelled away axially from this active sealing surface of the sealing profile so that they cannot adversely affect the sealing. This avoids the adverse effect which is occasionally observed in a combination of sealing films with sealing rings, specifically the remainder of the sealing film is retracted between the seal and the hollow needle upon puncturing. As a result of the clear functional connection of the piercing area to the peripheral sealing profile as claimed in the invention these disadvantages are effectively avoided.

The sealing element as claimed in the invention thus combines the advantages of a simple septum, specifically production and installation with low cost, with the advantages of a pierceable sealing film over a separate sealing arrangement, specifically the preparation of defined radial sealing surfaces for sealing the hollow needle. This improved functionality results first of all in that the deformations which occur when the piercing area is pierced and the associated forces are converted in a controlled manner into active manipulation or formation of the sealing profile. When the piercing area is pierced an optimized sealing arrangement is essentially automatically formed.

The sealing profile as claimed in the invention is preferably made as a sealing bead. The latter is formed by a notch which is trough-shaped in cross section and which runs annularly peripherally. This sealing bead is preferably axially opened to the inside with respect to the puncture direction. From the outside, therefore from the puncture side, the sealing bead thus forms a projecting sealing bulge.

The sealing bead is arranged such that the piercing area is connected to the inside edge of the sealing bead which is connected on its outside edge to the mounting element. This mounting element can be made as a tube section which can be fixed in the outlet opening. For example, one such sleeve-shaped mounting element can be inserted into the likewise tubular ink outlet of an ink reservoir and fixed therein.

In the above described embodiment, the sealing bead after splitting the piercing area when the hollow needle on its inner edge is inserted is bent moreover radially to the outside and drawn in the puncture direction by the arising friction forces of the suspended remainders of the piercing area. In this way the arched bottom area of the bead is twisted toroidally. In particular the sealing bead with the U-shaped cross section assumes the shape of an O ring on its inner periphery. Due to the swivelling and pulling motion of the split parts of the piercing area it is narrowed so that an especially internal opening cross section of this O ring-like seal yields moreover good radial sealing of the inserted hollow needle.

One especially advantageous embodiment of the invention as an alternative to the above described sealing bead calls for the sealing profile to be made as a sealing ring. Before the first use, i.e. before the first insertion of the hollow needle, the through opening of this sealing ring is sealed by the piercing area. This piercing area is made as a membrane-like, thin film which is connected to the inside edge of the sealing ring and has a smaller material thickness than the profile cross section of the sealing ring. The function and the resulting advantages of the sealing ring correspond essentially to the sealing bead. Upon piercing, first the puncture area is split by the hollow needle so that the through opening of the sealing ring is cleared. The friction forces acting upon axial insertion between the outside periphery of the inserted hollow needle and the inside periphery of the sealing ring twist this sealing ring around a peripheral line in the shape of a torus. This results in that the inside periphery, where the piercing area is connected to the sealing ring, is turned away from the surface of the inserted hollow needle, while moreover a peripheral sealing area is swivelled to the inside, surrounding the hollow needle tightly on the outside.

To achieve the aforementioned effect, the inside diameter of the sealing ring which is sealed first with the piercing area is chosen to be somewhat smaller than the outside diameter of the hollow needle. In this way, on the one hand it is ensured that the friction forces between the hollow needle and the sealing ring are large enough during puncture to twist the sealing ring around the peripheral line in the shape of a torus. On the other hand, the sealing ring consisting of rubber elastic material in the punctured state under radial pretensioning adjoins the hollow needle; this benefits good sealing action.

The sealing ring can have a round, preferably circular cross section. With the circular cross sectional profile a torus shape arises which corresponds to a classical O ring which can in the conventional manner adjoin a peripheral linear sealing surface on the hollow needle to form a good seal. In an individual case it can furthermore be advantageous for the sealing ring to have a rounded shape which deviates from the circular, for example an involute shape. In this way for example defined force ratios can be achieved between the hollow needle and the sealing ring upon puncture and after toroidal rerolling in the sealing state.

The sealing ring can moreover be connected via a peripheral, thin crosspiece to a mounting element. The mounting element is for example, as in the sealing bead, a tubular section, with the sealing element as claimed in the invention molded in one piece into its through cross section. The externally peripheral crosspiece is clearly thinner than the profile cross section of the sealing ring. In this way it can be swivelled easily when the hollow needle is inserted around a peripheral line which lies in the area of this thin crosspiece for executing the toroidal twisting as claimed in the invention.

In the version with the sealing ring the sealing profile can be made symmetrical with respect to the piercing plane. This piercing plane is defined by the piercing area. There is mirror symmetry to this surface when the sealing profile is made as an O ring with a circular profile cross section, the attachment to the mounting element taking place on the outer peripheral line and the piercing area being peripherally connected to the inside edge of the sealing ring. The symmetrical arrangement has advantages in production engineering. Moreover, installation is simplified thereby.

The piercing area can be made as a thin membrane with a smaller material thickness than that of the sealing profile or the sealing bead. Alternatively, the piercing area can have essentially the same material thickness as in the area of the sealing bead, but then can be provided with molded-in scored areas with a reduced material thickness. They are made for example as notches arranged in a line or cross-shape.

Preferably the connecting area between the piercing area and the sealing profile has a reduced material thickness. In this way, a type of annularly peripheral film hinge is formed which ensures that the separated areas of the sealing area when the hollow needle is inserted in the insertion direction are swivelled away from the sealing area of the sealing profile without the sealing profile being deformed in an uncontrolled manner.

Preferably the sealing element is produced from elastic material, such as natural or synthetic rubber materials or thermoplastic elastomers. But preferably the piercing area, the sealing element and the mounting element are made in one piece with one another. In this way not only simple and economical production, but also installation with low cost is enabled.

BRIEF DESCRIPTION OF THE DRAWINGS

This invention is detailed below using one embodiment with reference to the attached drawings.

DETAILED DESCRIPTION OF THE DRAWINGS

Figure 1:
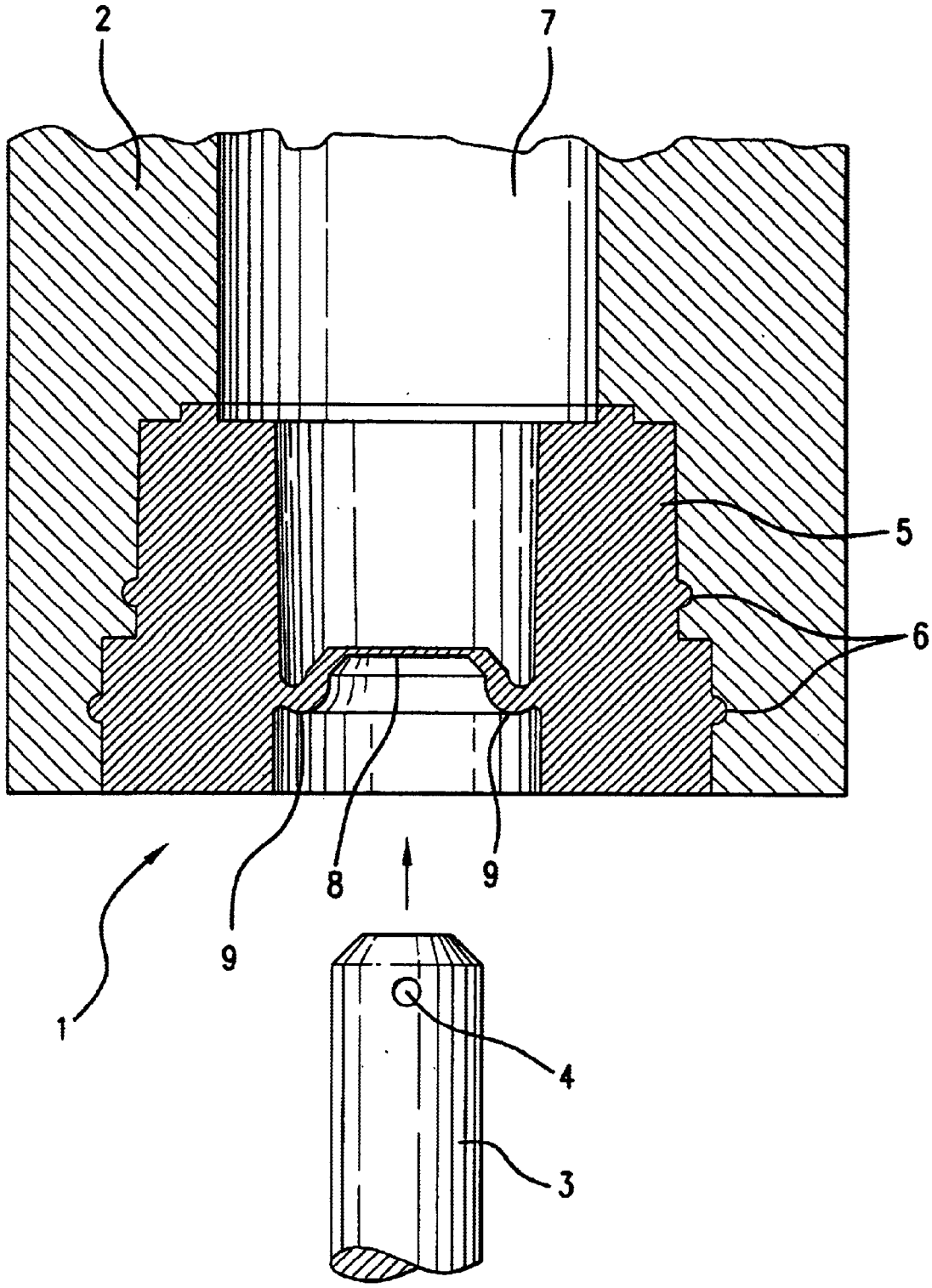
FIG. 1 shows a cross section through a sealing element as claimed in the invention in the closed state.

FIG. 1 shows a central lengthwise section through a sealing element as claimed in the invention which is provided as a whole with reference number 1. It is inserted from underneath into the through opening of a tubular liquid outlet 2 which preferably forms the ink outlet of an ink cartridge which is not further shown. It comprises an ink tank which adjoins the liquid outlet 2 to the top and is filled with ink for operating an inkjet printing system. This representation and the detailed view in FIG. 2 in which the section is turned by 90° around the lengthwise axis show the pierceable sealing element 1 in the unused, i.e. the state not yet punctured for liquid removal.

Reference number 3 labels a hollow needle for liquid removal, preferably the ink withdrawal needle installed in an inkjet printing system. It is made relatively blunt on its tip which lies at the top in the drawing and is provided with side removal openings 4. The arrow labels the puncture direction in FIG. 1 and FIG. 3, when the ink cartridge is inserted with its liquid outlet 2 into the inkjet printing system.

The sealing element 1 is made as a whole in one piece with all components out of thermoplastic elastomer or rubber material. It comprises a mounting element 5 with the shape of an essentially tubular section which can be inserted in the representation from underneath into the passage of the liquid outlet 2 to form a seal and is fixed there by interlocking by means of peripheral catch projections 6 in the corresponding grooves in the liquid outlet 2.

Figure 2:
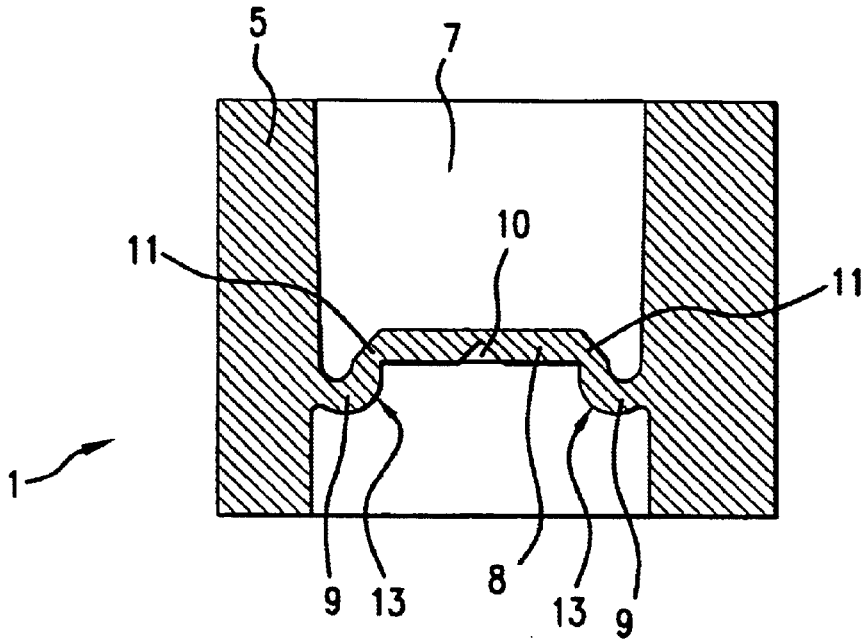
FIG. 2 shows a detailed view of the sealing element as shown in FIG. 1 turned by 90°.

The receiving space in the sealing element 1 into which the hollow needle 3 can be punched and which is the liquid removal channel 7 which passes through the mounting element 5 is sealed in the intact state as shown in FIG. 1 and FIG. 2 by the arrangement as claimed in the invention. It comprises a central piercing area 8 which has the shape of a round disk and which is connected on the edge to the inside edge of the peripheral sealing bead 9 which forms the sealing profile as claimed in the invention. Here the diameter of the piercing area 8 is roughly the same size or somewhat larger than the diameter of the hollow needle 3. In this way, in the puncture process the tip of the hollow needle 3 first comes into contact with the bottom of the piercing area 8, there being radial play to the sealing bead.

Figure 3:
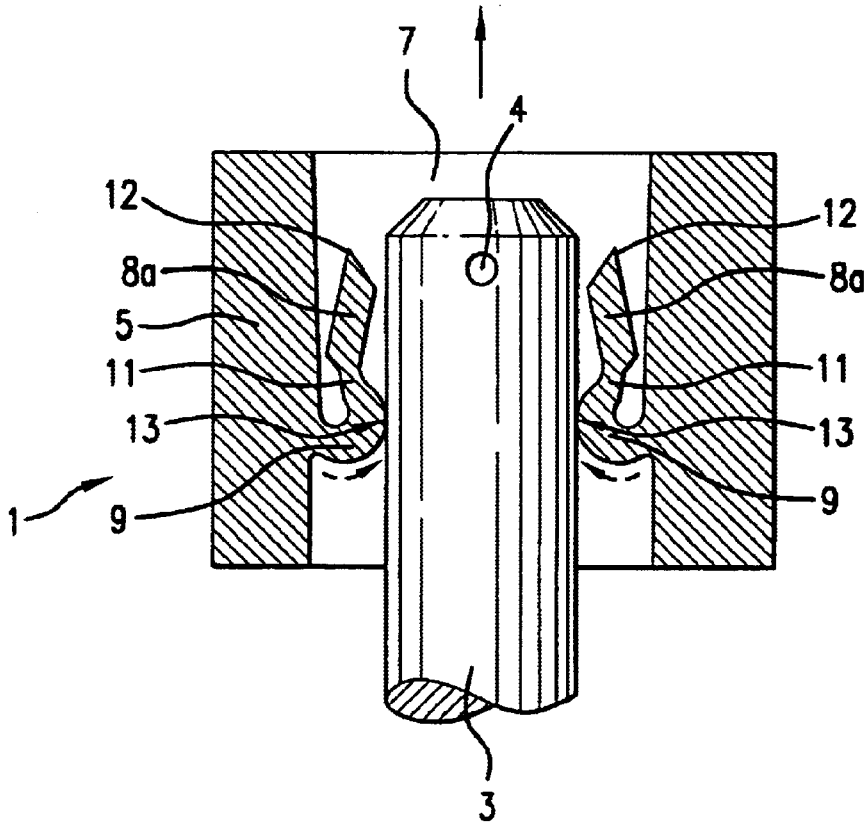
FIG. 3 shows the sealing element as in FIG. 2 in the punctured state.

The sealing bead 9 is made roughly U-shaped in cross section, the trough profile formed thereby being opened toward the inside of the liquid tank, therefore to the top in the representations from FIGS. 1 to 3. FIG. 2 clearly shows that the material thickness of the piercing area 8 essentially corresponds to the bent part of the sealing bead 9.

As the central scored location, a recess 10 which is V-shaped in cross section is molded from underneath into the piercing area 8 and lies in the plane of the drawing in FIG. 1. In this way the material is made thinner.

In the connecting area 11 where the piercing area 8 is molded to the inner edge of the sealing bead 9, the bevelling reduces the material thickness so that a type of peripheral film hinge between the material of the piercing area 8 and the sealing bead 9 is formed there.

Operation becomes apparent using the representation in FIG. 3 which shows the same view as FIG. 2. When the liquid outlet 2 is seated, when for example an ink cartridge provided with it is inserted into an inkjet printer, the hollow needle 3 in the view shown in the arrow direction is moved from bottom to top first as far as against the bottom of the piercing area 8. The continuation of this puncture motion leads to the piercing area 8 on the recess 10 tearing open and clearing the entry of the hollow needle 3 into the through opening 7. The partial areas of the through area 8 which are separated from one another and which in FIG. 3 are labelled with reference number 8*a* are pressed away radially to the outside by the penetrating hollow needle 3 in a swivelling motion; this is shown in FIG. 3 with the small arrows on the component areas 8*a*. The representation in FIG. 3 shows clearly that the tear edges of the areas 8*a* of the puncture area 8, i.e. the edges labelled with reference number 12, and which areas lay previously in the area of the recess 10, do not contribute to sealing of the hollow needle 3. The sealing on the outside periphery of the hollow needle 3 is achieved as claimed in the invention rather in that the sealing bend 9 in the piercing process is toroidally rerolled around the peripheral line by the bending-up of the component areas 8*a* of the piercing area 8, i.e. is twisted in itself around a peripheral line. By this purposeful deformation, the areas which are used as sealing surfaces 13 and which lie on the outside of the sealing bead 9 are swivelled radially to the inside such that they form an annularly peripheral seal which rests radially from the outside on the periphery of the hollow needle 3. In other words, only when the hollow needle is inserted is an O ring-like sealing arrangement formed from the sealing bead 9.

Operation of the sealing bead 9 can be clearly seen from combined examination of FIGS. 2 and 3. In FIG. 2 the areas used as sealing surfaces 13 are located on the outside of the sealing bead first outside the puncture area 8. When the hollow needles 3 is inserted they are swivelled to the inside by the described toroidal motion; this is shown in FIG. 3 with the broken arrows along the outside periphery of the sealing bead 9. Here, the through cross section likewise narrows within the sealing bead 9 so that due the peripheral sealing surface 13 which in contrast to the tear edges 12 has a defined, smooth sealing surface, optimized sealing of the hollow needle 3 in the sealing element 1 is achieved.

It follows from the representation in FIG. 3 that the sealing bead 9 in the inserted state of the hollow needle 3 in the area of the piercing opening assumes roughly the shape of an O ring which forms an especially good seal for the hollow needle 3. In contrast to the previously known pierceable sealing elements which are equipped from beforehand with separate O rings in the arrangement with a pierceable sealing film, the special shaping as claimed in the invention forms an O ring-like sealing element only directly when the hollow needle 3 is inserted. The advantage of the pierceable sealing element 1 as claimed in the invention consists in that it can be especially favorably produced in one piece and can also be easily installed. Here the sealing is greatly improved compared to a septum which is likewise simple to produce.

Figure 4:
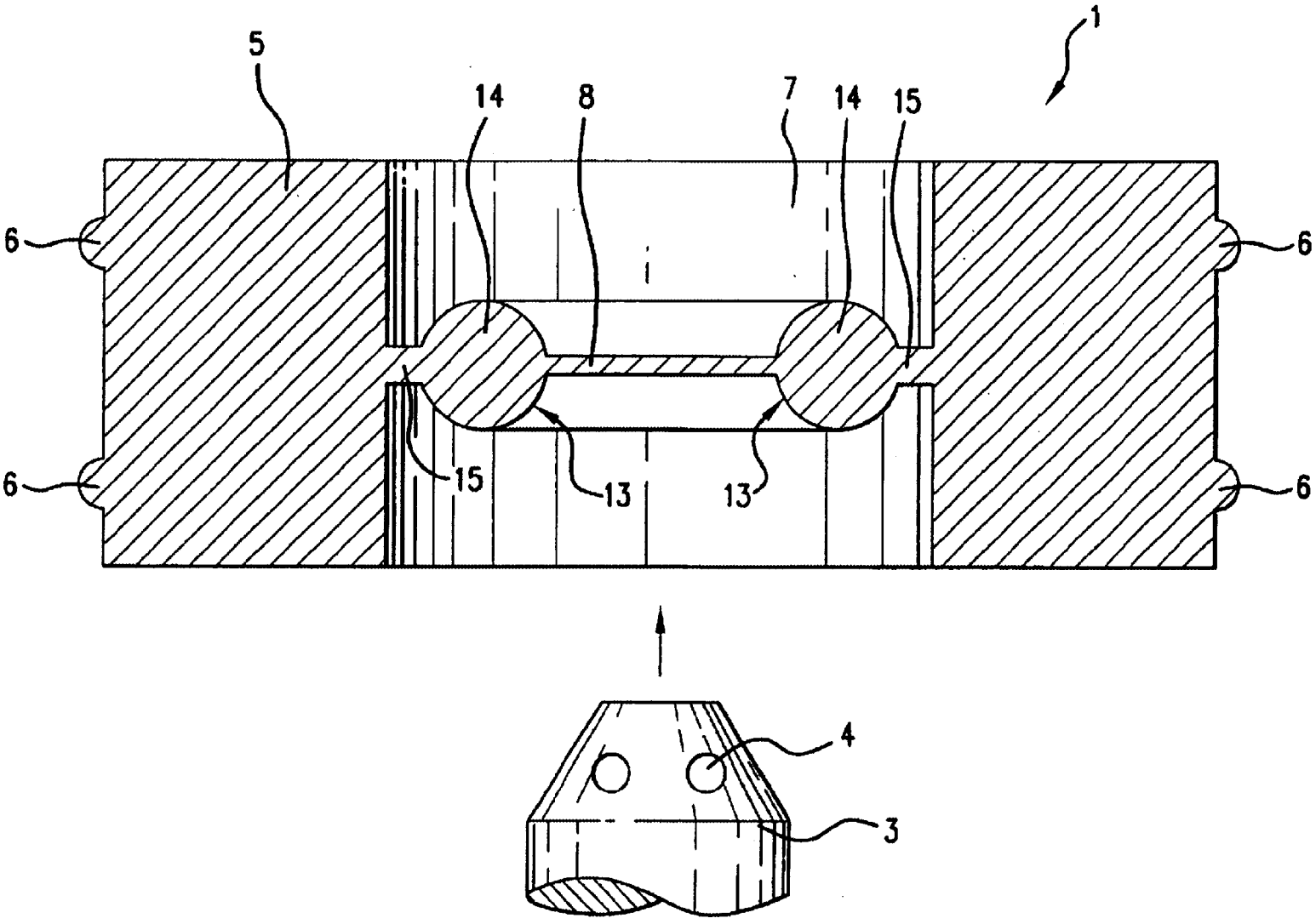
FIG. 4 shows a cross section through the sealing element as claimed in the invention in a second embodiment in the closed state.
Figure 5:
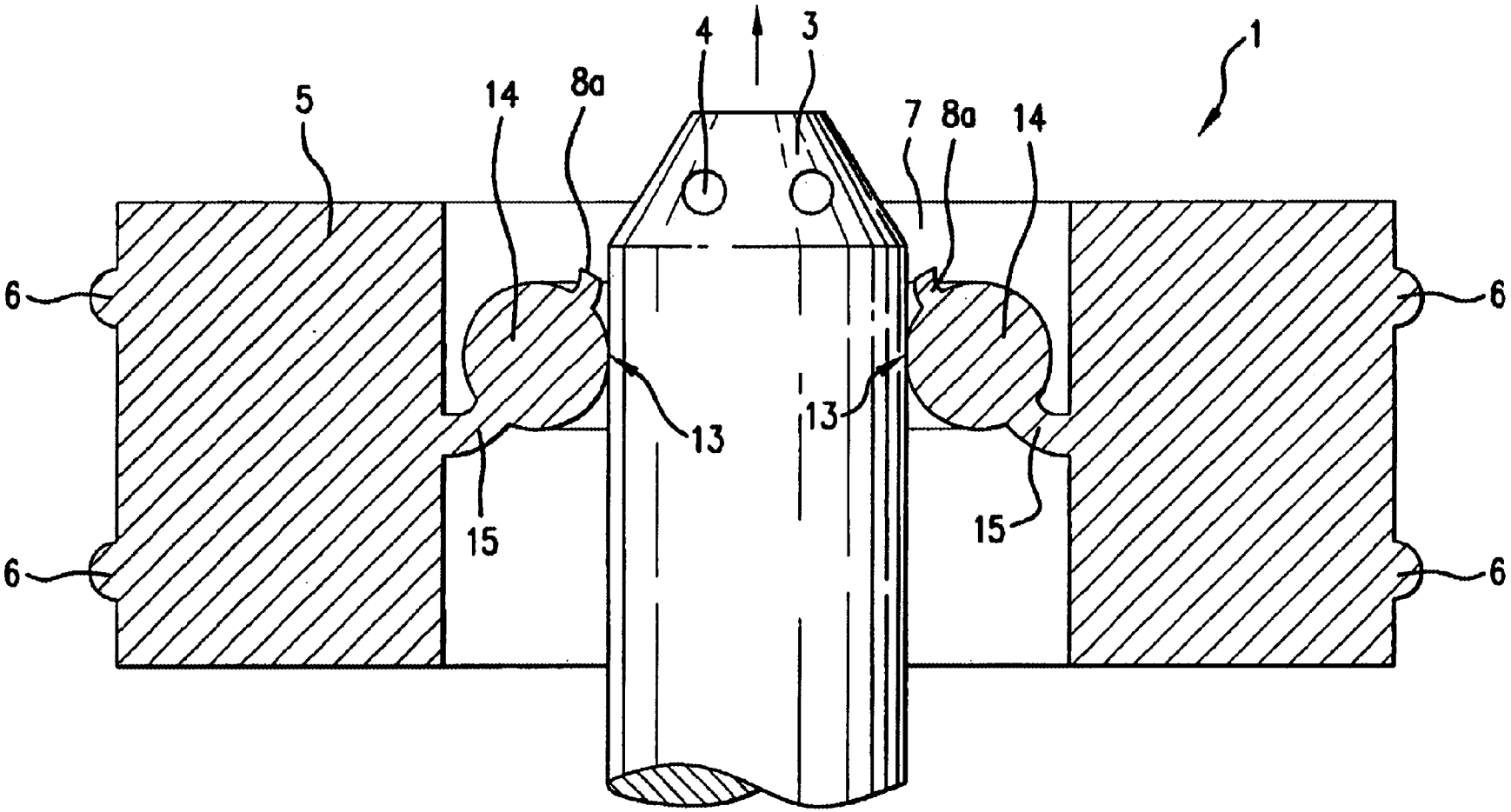
FIG. 5 shows a cross section through the sealing element as shown in FIG. 4 in the punctured state.

FIGS. 4 and 5 show a sealing element 1 as claimed in the invention in a second embodiment, for the same functional elements the same reference numbers being used as in the preceding figures. FIG. 4 shows analogously to FIG. 2 in turn the unused, i.e. intact state, while FIG. 5 analogously to FIG. 3 shows the operating state with an inserted hollow needle 3.

The sealing element 1 comprises likewise a tubular mounting element 5. It has a continuous liquid removal channel 7 which in the intact state as shown in FIG. 4 is sealed by an arrangement as claimed in the invention. It has a sealing profile in the form of a sealing ring 14 which replaces the sealing bead 9 as shown in FIGS. 1 and 2. In this embodiment, this sealing ring 14 has a round cross section, by which it essentially forms an O ring. The piercing area 8 extends as a thin membrane over the opening of this sealing ring 14. The latter is integrally connected on its outside periphery over a peripheral thin crosspiece 15 to the inside periphery of the through opening 7 of the mounting element 5.

The piercing area 8 can likewise be provided with scored sites as in the versions in FIGS. 1 to 3, but they are not explicitly shown.

Operation can in turn be explained using the succeeding phases when the hollow needle 3 is inserted as shown in FIGS. 4 and 5. In FIG. 4 the through opening 7 is sealed tight in the mounting element 5 by the sealing ring 14 and the piercing area 8 and by the crosspiece 15. The hollow needle 3 is inserted axially from underneath in the direction of the arrow.

It is noteworthy in this connection that the outside diameter of the hollow needle 3 is slightly less than the inside diameter of the sealing ring 14, i.e. also of the piercing area 8.

It can be taken from FIG. 5 that the piercing area 8 bursts when punctured, component areas 8*a* remaining on the inner edge of the sealing ring 14. Due to the axial forces which act between the outside periphery of the hollow needle 3 and the inside periphery of the sealing ring 14 upon puncture, the needle is twisted in itself toroidally around a peripheral line; this is indicated in FIG. 5 with the bent arrows. In this way the peripheral areas of the sealing ring 14 which are used as the sealing surfaces 13 come into peripheral sealing contact with the outside periphery of the hollow needle 3. Moreover, the component areas 8*a* with their tear edges which are in part irregular are swivelled away from the surface of the punctured hollow needle 3. Because the hollow needle 3 has a slightly larger diameter than the inside diameter of the sealing ring 14, the sealing surfaces 13 adjoin especially securely to form a seal under radial pretensioning.

The version shown in FIGS. 4 and 5 has the same good sealing properties as the one given in FIGS. 1 to 3. This advantage results from the fact that the sealing ring 14 is likewise brought into its final sealing position by means of the hollow needle 3 only after piercing the piercing area 8. Another advantage of this arrangement is the symmetrical structure with respect to the piercing plane which is defined by the piercing area 8 and can be seen especially easily in FIG. 4. In this way installation and production are simplified.

What is claimed is:

1. A pierceable sealing element for a liquid outlet, comprising:

a membrane which can be pierced by a hollow needle for removing liquid, and an annularly peripheral sealing profile surrounding said membrane, said sealing profile rotating to engage said hollow needle when said membrane is pierced from below by said hollow needle.

2. The sealing element as claimed in claim 1, wherein the sealing profile is made as a sealing bead.

3. The sealing element as claimed in claim 2, wherein the sealing bead is opened axially to the inside with respect to a puncture direction.

4. The sealing element as claimed in claim 2, wherein the sealing bead has a U-shaped cross section.

5. The sealing element as claimed in claim 2, wherein the membrane is connected to the inside edge of the sealing bead.

6. The sealing element as claimed in claim 2, wherein the sealing bead is connected on an outside edge to a mounting element.

7. The sealing element as claimed in claim 1, wherein the sealing profile is made as a sealing ring.

8. The sealing element as claimed in claim 7, wherein the sealing ring has a round, circular cross section.

9. The sealing element as claimed in claim 7, wherein the sealing ring is connected to a mounting element via an externally peripheral thin crosspiece.

10. The sealing element as claimed in claim 7, wherein the membrane is peripherally connected to an inside edge of the sealing ring.

11. The sealing element as claimed in claim 1, wherein the sealing profile is made symmetrical with respect to a piercing plane.

12. The sealing element as claimed in claim 1, wherein a mounting element connected to the sealing profile, is made as a tube section which is fixed in an outlet opening.

13. The sealing element as claimed in claim 1, wherein a mounting element connected to the sealing profile, is inserted in an ink outlet channel of an ink reservoir.

14. The sealing element as claimed in claim 1, wherein the membrane is made as a membrane with a material thickness less than that of the sealing profile.

15. The sealing element as claimed in claim 1, wherein the membrane has molded-in scored areas with a reduced material thickness.

16. The sealing element as claimed in claim 1, wherein a connecting area between the membrane and the sealing profile has reduced material thickness.

17. The sealing element as claimed in claim 1, wherein the sealing element comprises an elastic material.

18. The sealing element as claimed in claim 1, wherein the membrane, the sealing profile or a mounting element connected to the sealing profile, is made in one piece.

19. An ink reservoir for detachable mounting in an inkjet printing means, comprising:

an ink outlet opening, a pierceable sealing element having a membrane which can be pierced by a hollow needle of the inkjet printing means for removing ink, and an annularly peripheral sealing profile surrounding said membrane, said sealing profile rotating to engage said hollow needle when said membrane is pieced from below by said hollow needle.

20. The ink reservoir as claimed in claim 19, wherein the sealing profile is made as a sealing bead.

21. The ink reservoir as claimed in claim 20, wherein the sealing bead is opened axially to the inside with respect to a puncture direction.

22. The ink reservoir as claimed in claim 20, wherein the sealing bead has a U-shaped cross section.

23. The ink reservoir as claimed in claim 19, wherein the membrane is connected to the inside edge of the sealing bead.

24. The ink reservoir as claimed in claim 20, wherein the sealing bead is connected on an outside edge to a mounting element.

25. The ink reservoir as claimed in claim 19, wherein the sealing profile is made as a sealing ring.

26. The ink reservoir as claimed in claim 25, wherein the sealing ring has a round, circular cross section.

27. The ink reservoir as claimed in claim 25, wherein the sealing ring is connected to a mounting element via an externally peripheral thin crosspiece.

28. The ink reservoir as claimed in claim 25, wherein the membrane is peripherally connected to an inside edge of the sealing ring.

29. The ink reservoir as claimed in claim 19, wherein the sealing profile is made symmetrical with respect to a piercing plane.

30. The ink reservoir as claimed in claim 19, wherein a mounting element connected to the sealing profile, is made as a tube section which is fixed in an outlet opening.

31. The ink reservoir as claimed in claim 19, wherein a mounting element connected to the sealing profile, is inserted in an ink outlet channel of an ink reservoir.

32. The ink reservoir as claimed in claim 19, wherein the membrane is made as a membrane with a material thickness less than that of the sealing profile.

33. The ink reservoir as claimed in claim 19, wherein the membrane has molded-in scored areas with a reduced material thickness.

34. The ink reservoir as claimed in claim 19, wherein a connecting area between the membrane and the sealing profile has reduced material thickness.

35. The ink reservoir as claimed in claim 19, wherein the sealing element comprises an elastic material.

36. The ink reservoir as claimed in claim 19, wherein the membrane, the sealing profile or a mounting element connected to the sealing profile, is made in one piece.

37. A pierceable sealing element for a liquid outlet, comprising:

an annular sealing profile having a central area, a pierceable membrane extending across and closing said central area, and said annular sealing profile having a sealing surface located below said pierceable membrane, said annular sealing profile rotating when said membrane is pierced by a hollow needle to have said sealing surface contact said hollow needle.

38. The pierceable sealing element of claim 37, wherein said annular sealing profile has a U-shaped cross section.

39. The pierceable sealing element of claim 37, further comprising a mounting element, said annular sealing profile connected to said mounting element by a cross piece.

* * * * *